US005730489A

United States Patent [19]

Eberle et al.

[11] Patent Number: 5,730,489

[45] Date of Patent: Mar. 24, 1998

[54] COMBINATION FOLDING CHAIR AND TABLE HAVING A SMALL PROFILE WHEN FOLDED

[76] Inventors: Robert A. Eberle, 12236 Belleview, Kansas City, Mo. 64145; Drake L. Koch, 3309 Genessee, Kansas City, Mo. 64111

[21] Appl. No.: 731,203

[22] Filed: Oct. 10, 1996

Related U.S. Application Data

[60] Provisional application No. 60/005,626, Oct. 19, 1995.

[51] Int. Cl. [6] ..... A47C 4/24

[52] U.S. Cl. ..... 297/53; 297/183.5; 297/188.04; 297/239

[58] Field of Search ..... 291/16.1, 52, 53, 291/125, 183.5, 188.04; 108/120

[56] References Cited

U.S. PATENT DOCUMENTS 1,217,772 2/1917 Kade ..... 108/120
3,695,687 10/1972 Uyeda ..... 297/56

*Primary Examiner*—Peter R. Brown
*Attorney, Agent, or Firm*—Kenneth W. Iles

[57] ABSTRACT

A folding chair/table includes a rigid seat attached to an X-frame with four legs that fold and then slide under the seat and parallel to it for storage and a rigid backrest connected to a separate backrest frame pivotally attached to the seat, which is stopped from over rotation by the rearwardly upwardly sloping rear legs. The backrest and backrest frame pivot forwardly and downwardly to a position in contact with the front of the seat to form a table.

15 Claims, 14 Drawing Sheets

COMBINATION FOLDING CHAIR AND TABLE HAVING A SMALL PROFILE WHEN FOLDED

BACKGROUND OF THE INVENTION

Cross-Reference to Related Applications

This application claims the benefit of the filing date of U.S. provisional patent application Ser. No. 60/005,626, filed Oct. 19, 1995.

1. Field of the Invention

The present invention is related to a folding chair. More particularly, the present invention is related to a folding chair that also serves as a table and that folds into a compact substantially rectilinear package.

2. Description of Related Art Including Information Disclosed Under 37 C.F.R. Sections 1.97–1.99

Folding chairs are commonly used for temporary or portable seating arrangements in auditoriums, family gatherings, and so forth. They can be more or less easily stored in their folded or collapsed position.

A popular folding chair is disclosed in U.S. Pat. No. 3,695,687, which discloses a folding chair with plastic parts that prevent metal-to-metal contact when two or more of the chairs are set up next to each other or when they are stacked. The front legs of the unfolded chair extend rearwardly and upwardly from the ground at the front of the chair past the seat and, upwardly of the seat, form a frame for the backrest. This construction dictates that the folded chair is longer than the chair is high in its unfolded state. Further, the backrest is concave (when viewed from the front of the chair), the lower edge of the rear surface of the backrest includes a protruding reenforcing ridge and the seat includes a bottom scoop. When the chair is folded, these curved surfaces prevent the chair from defining a rectilinear package with substantially straight lines. This chair cannot be folded into a shape shorter than the total length of the front legs and backrest support, which limits the portability, ease of transportation, and use of the chair. Further, this chair is suitable for use only as a chair.

Therefore, a need exists for a folding chair that is more compact and regularly shaped when folded than is the prior art; that can be folded to form a table; and that provides a full-sized standard material rigid seat and backrest.

SUMMARY OF THE INVENTION

Accordingly, it is a primary object of the present invention to provide a folding chair that is more compact and regularly shaped when folded.

It is another object of the present invention to provide a folding chair that can also be folded to form a table.

It is another object of the present invention to provide a chair having a full-sized standard material rigid seat and backrest.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

Figure 1:
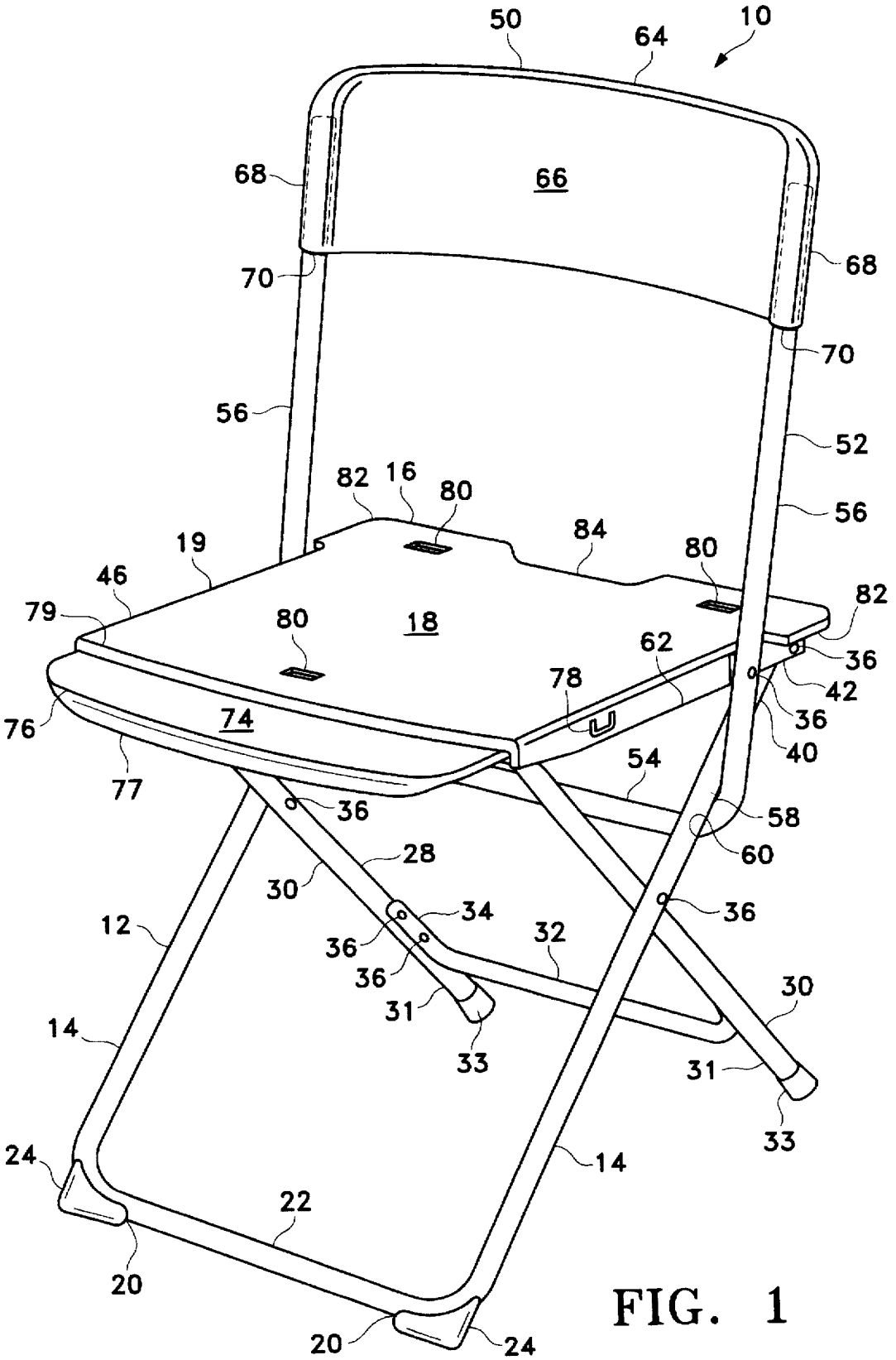
FIG. 1 is a front right-hand perspective view of a chair/table according to the present invention shown in its unfolded position ready for use.
Figure 2:
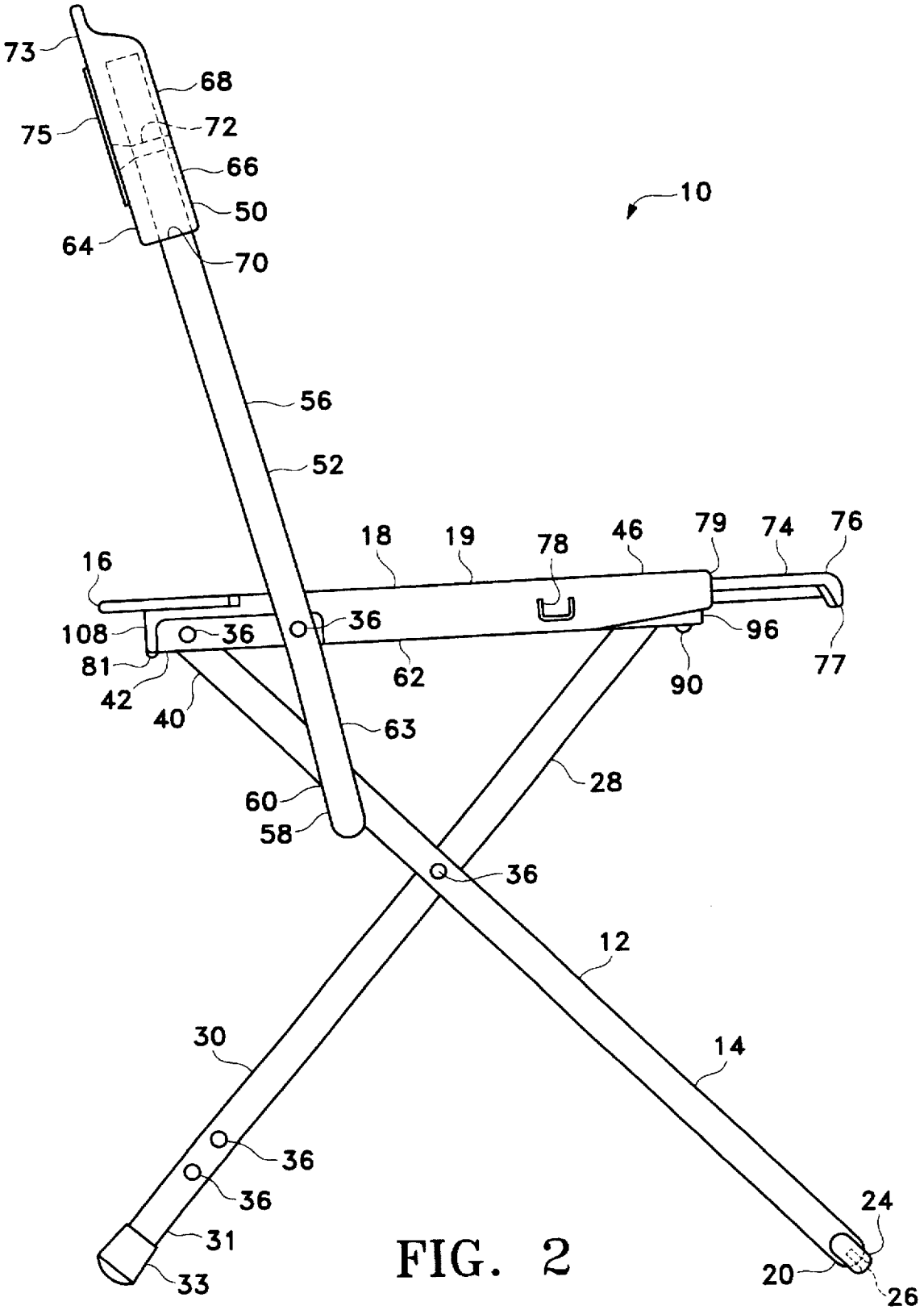
FIG. 2 is a side elevation of the chair/table of FIG. 1.

Referring to FIG. 1, a folding chair/table 10 according to the present invention includes a front leg frame 12 having a pair of parallel front legs 14 that slope downwardly and forwardly of a rear edge 16 of a seat 18 and terminate at their lower ends in front feet areas 20, with each front foot 20 connected by a front legs reenforcing member 22, which is integrally formed with the front legs 14 from bent metal tubing. A leveling resilient tip lug 24 is attached to each front foot 20 by a countersunk rivet 26 (FIG. 2).

A rear leg frame 28 includes a generally U-shaped frame having a pair of downwardly and rearwardly sloping parallel rear legs 30 and a rear leg frame brace 32 having an upturned curved flange 34 at each end for attachment to the rear legs 30 by a pair of rivets 36 in each curved flange 34. The curvature of the flanges 34 matches the diameter of the rear legs 30 for sound mechanical connection. The upper ends of the rear legs 30 are connected by a horizontal stabilizer member 38 (FIG. 6) defining the bottom channel element of the U-shaped rear leg frame 28, with the rear legs 30 and horizontal stabilizer member 38 preferably integrally formed from a single tubular member. The bottom end 31 of each rear leg 30 is covered by a resilient tip 33 to reduce pressure on the supporting surface.

When the chair/table 10 is erected, the front leg frame 12 and the rear leg frame 28 cross to form an X-pattern with each of their two crossing points pivotally fastened with a rivet 36. Each rear leg 30 is inside of each front leg 14, with inside defined as toward the middle of the seat 18 from the seat perimeter 46.

The seat 18, preferably made from injection molded plastic, such as polypropylene, is pivotally attached to the tops 40 of the front legs 14 by a rivet 36 in each rear leg 20, and through an abutted sheet metal reinforcement strip 42, and then through a depending skirt portion 62 of the seat 18. The seat 18 includes an upper surface seating area 19, which generally matches the backrest 50 in color, texture, material and so forth, and both of which may include a pebbled or otherwise textured surface, as well as optional vent holes (not shown). The seat 18 and backrest 50, while preferably plastic, must be made from a rigid or semi-rigid material that is not collapsible, as canvas or other fabric are. The plastic has some give in it, so that the user's bottom and back will deform the seat 18 and seat back 50 somewhat to conform to the user's anatomy. Alternatively, the seat 18 may be made marginally thicker to allow for a sculpted bottom scoop area. The rear legs 30 are attached to a point immediately adjacent to a rear edge 16 of the seat 18.

Figure 3:
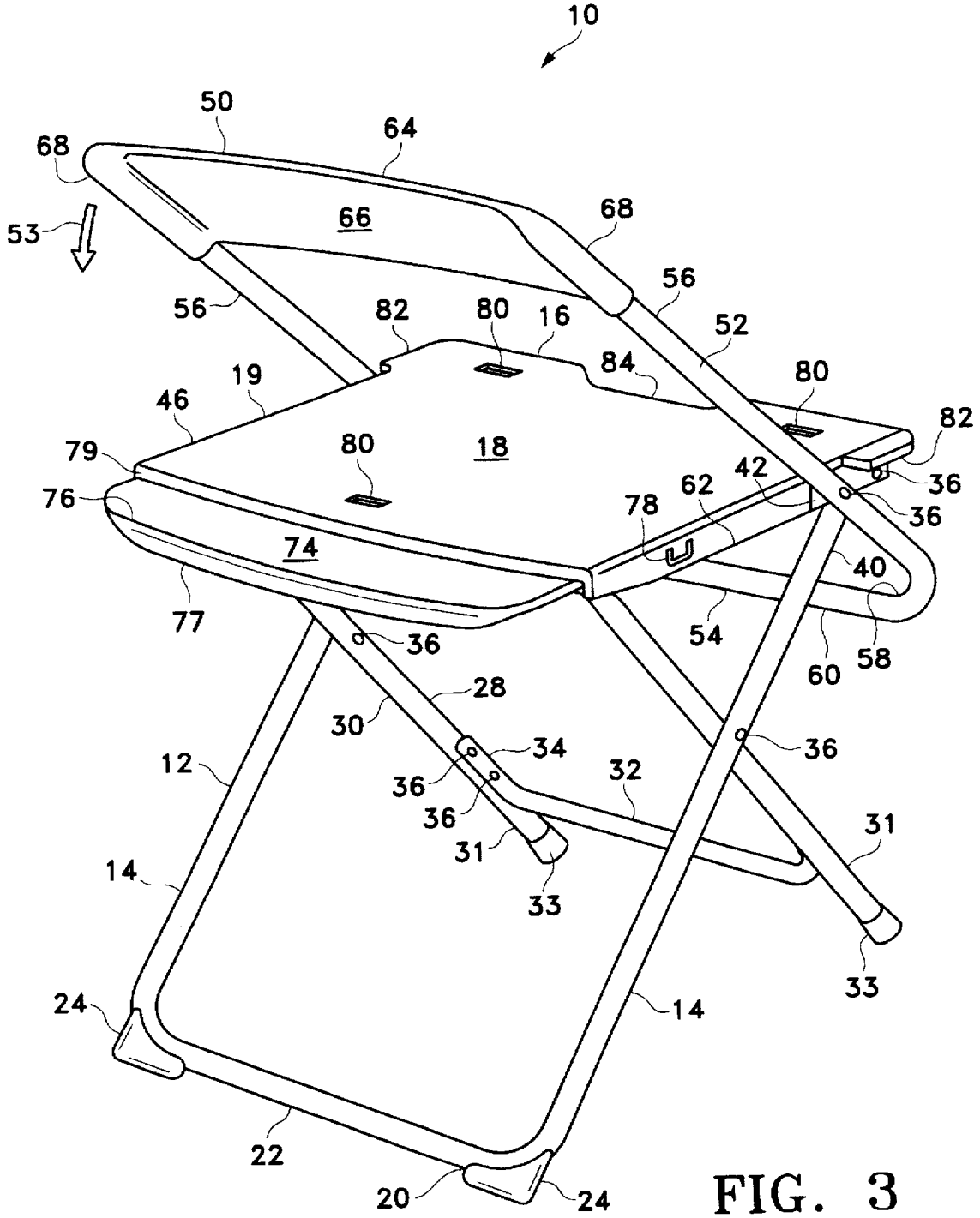
FIG. 3 is a front right-hand perspective view of the chair/table of FIG. 1 illustrating the rotational folding of the backrest.

A backrest 50 includes a U-shaped backrest frame 52 having a horizontal backrest brace 54 connected to a pair of upstanding rearwardly inclined backrest support members 56, with a backrest support member 56 attached to each end of the horizontal backrest brace 54. The U-shaped backrest frame 52 is preferably made of a single length of bent tubing, resulting in a pair of characteristically flattened bends 58, that strike a stop portion 60 on each rear leg 30 and thereby maintain the erected seat rest 50 in the desired position when the chair/table 10 is used for seating. Each backrest support member 56 is pivotally attached to a depending skirt portion 62 of the seat 18 by a rivet 36, which also penetrates the sheet metal reinforcement strip 42. The backrest locking portion 63 of each backrest support member 56 below the point of attachment to the seat 18 is bent away from a straight line by about 3–8 degrees to prevent the locking portion 63 from striking the shoulders 82 of the seat 18 when the backrest 50 is folded down to form a table (clearly seen in FIG. 2), while bringing the backrest frame 52 close to the seat perimeter seat 46 for a neater appearance when the backrest 50 is in its closed or folded position and to allow the molded latching lug 78 to engage the backrest support members 56. The backrest 50 pivots about the rivets 36 in its frame 52 forwardly and downwardly in the direction of the arrow 53 (FIG. 3) to form a table (FIGS. 4, 5), and pivots in the opposite direction to form a chair (FIGS. 1, 2).

A back support 64 is preferably made of injection molded plastic and includes a back support strip 66 having an integrally formed sleeve 68 at each end and a bore 70 in each sleeve 68 for receiving the top end of each backrest support member 56. A countersunk rivet 72 penetrates each sleeve 68 and the backrest support member 56 therein to reduce twisting when the backrest 50 is subjected to torsional forces (FIG. 2). The rear surface 73 of the back support strip 66 includes an upstanding pair of cup rings 75 (e.g., FIGS. 2, 4, and 5) for use when the chair/table 10 is used as a table (e.g., FIGS. 4, 5).

Figure 4:
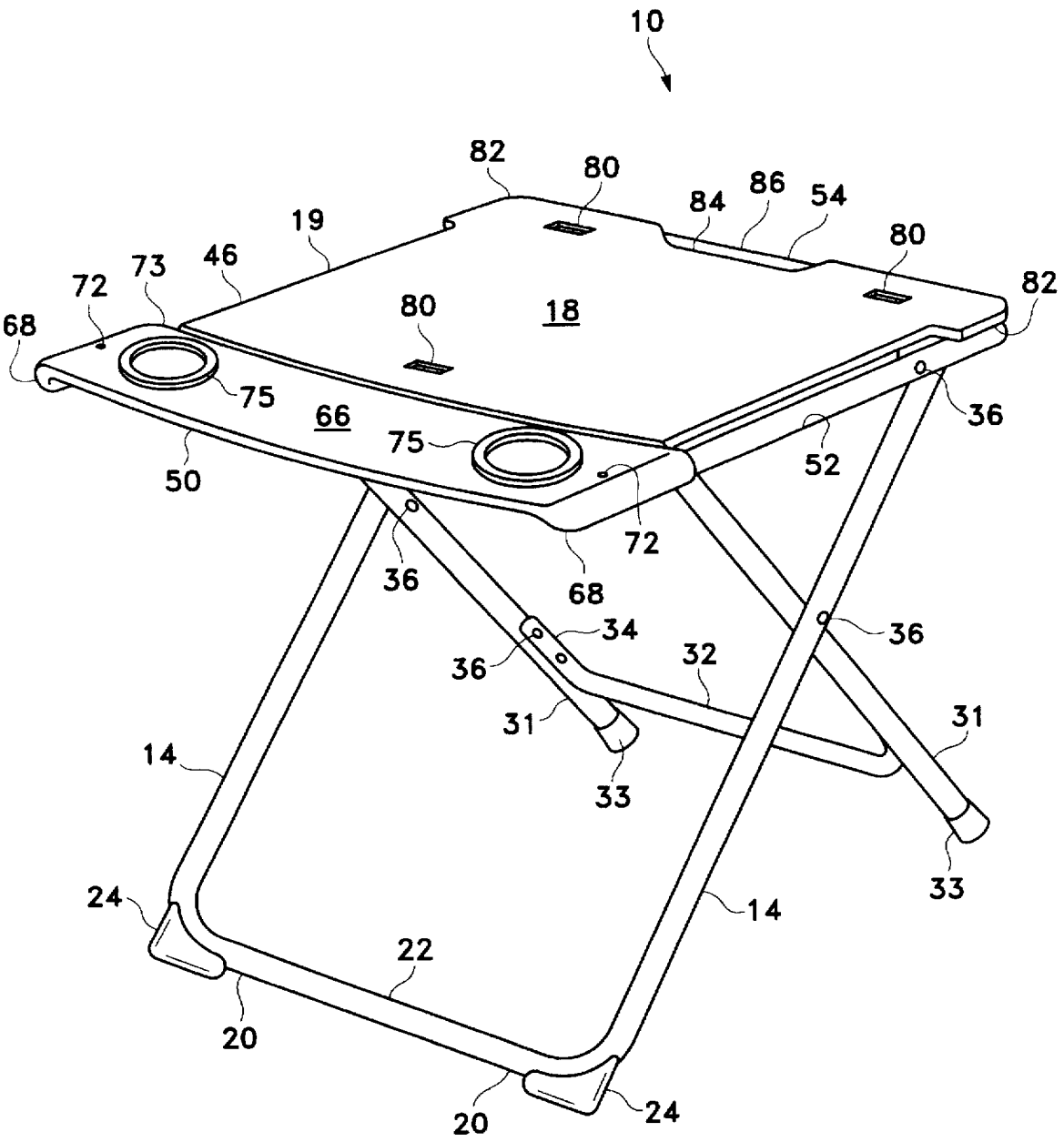
FIG. 4 is a left-hand front perspective view of the chair/table of FIG. 1 with the backrest fully folded down, forming a table.
Figure 5:
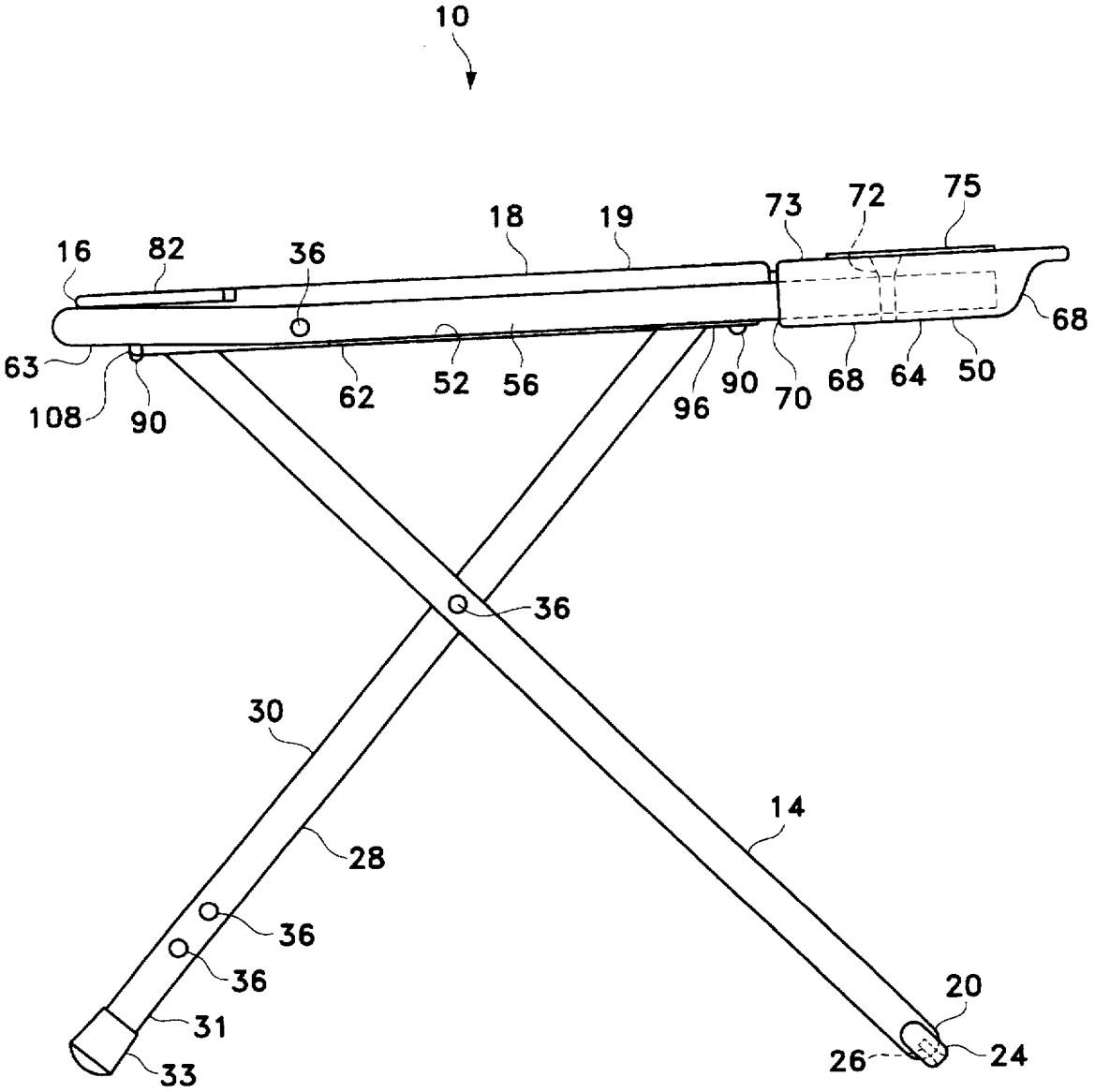
FIG. 5 is a side elevation of the chair/table of FIG. 3 showing the chair/table of FIG. 4.
Figure 6:
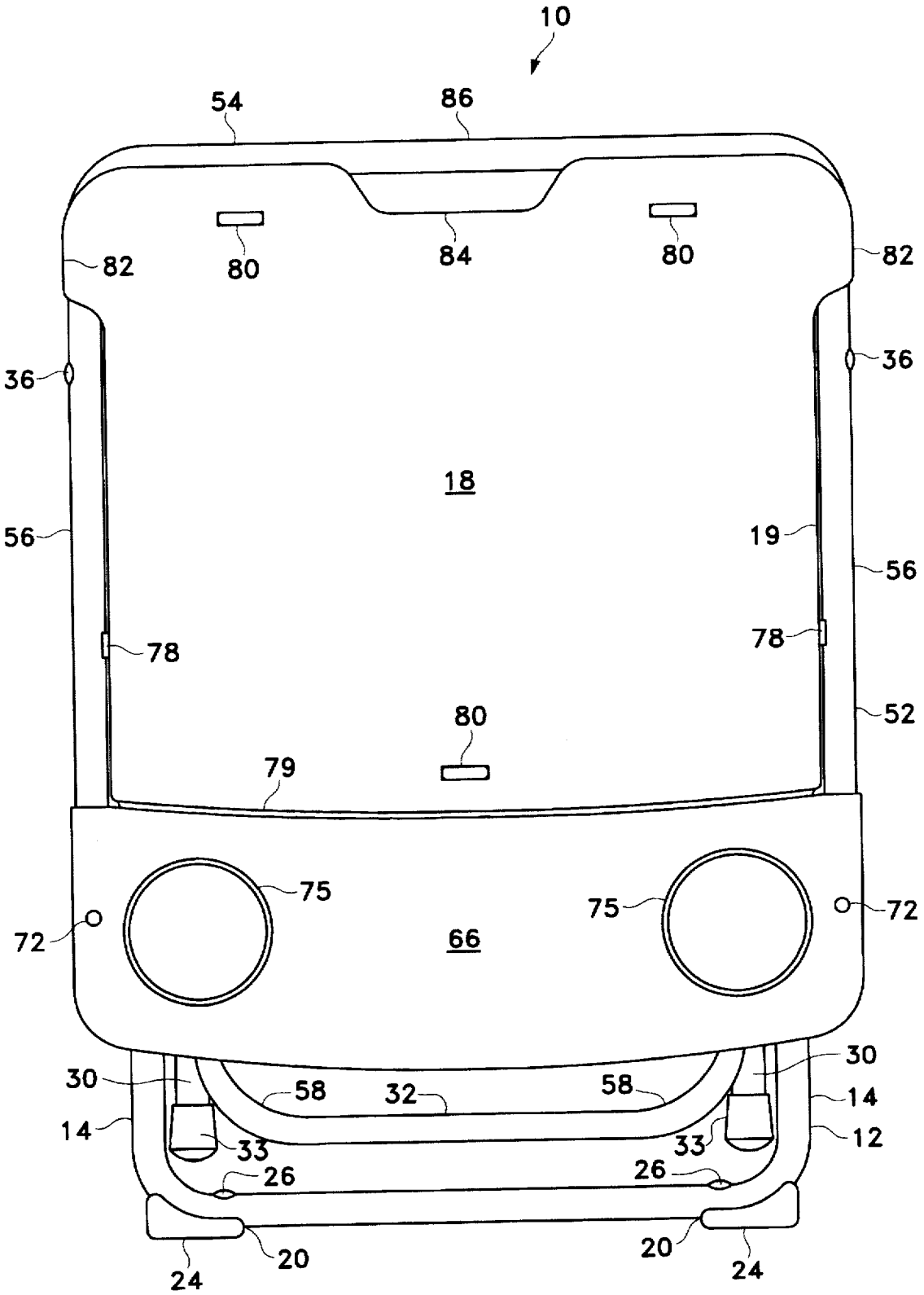
FIG. 6 is a top plan view of the chair/table of FIG. 1 shown in the fully folded storage and transport position.

The seat 18 includes a stepped-down portion 74 adjacent to the front edge 76, defined by the downward step 79, for receiving the back support strip 66 when the backrest 50 is folded down to form a table. The front edge 76 slopes downwardly to form a depending leading edge lip 77, which serves as a reinforcement rib. A molded latching lug 78 integrally formed into the depending skirt portion 62 on both sides of the seat 18 retains the backrest 50 in its folded position during transport or storage but its resistance is easily overcome during set up. Three stacking lug receiving slots 80 penetrate the seat 18, with two stacking lug receiving slots 80 lying adjacent to the rear edge 16 of the seat 18 and one adjacent to the front edge 76 of the seat 18 and opposed to the midpoint of the line between the two rear stacking lug receiving slots 80. Each stacking lug receiving slot 80 receives a snap-fitting frictional engagement stacking lug 90 when folded chair/tables 10 are stacked together, whether horizontally or vertically oriented (FIG. 2). Between the erected backrest support members 56 and the rear edge 16 of the seat 18 on each side of the seat 18, the seat 18 has a pair of widened portions, or shoulders 82, that prevent metal-to-metal contact of the frame members 52 when the folded chair/tables 10 are set up next to each other or stacked (FIG. 4). The frames 12, 28 of adjacent chairs cannot touch each other because they are inside the seat perimeter 46. A handle access indentation 84 lies along the rear edge 16 of the seat 18 and is centered about the midpoint of the rear edge 16, allowing the middle portion of the horizontal backrest brace 54 to serve as a handle 86 for gripping the chair/table 10 for convenient carrying when the chair/table is fully folded (FIGS. 4, 6, 7).

Figure 7:
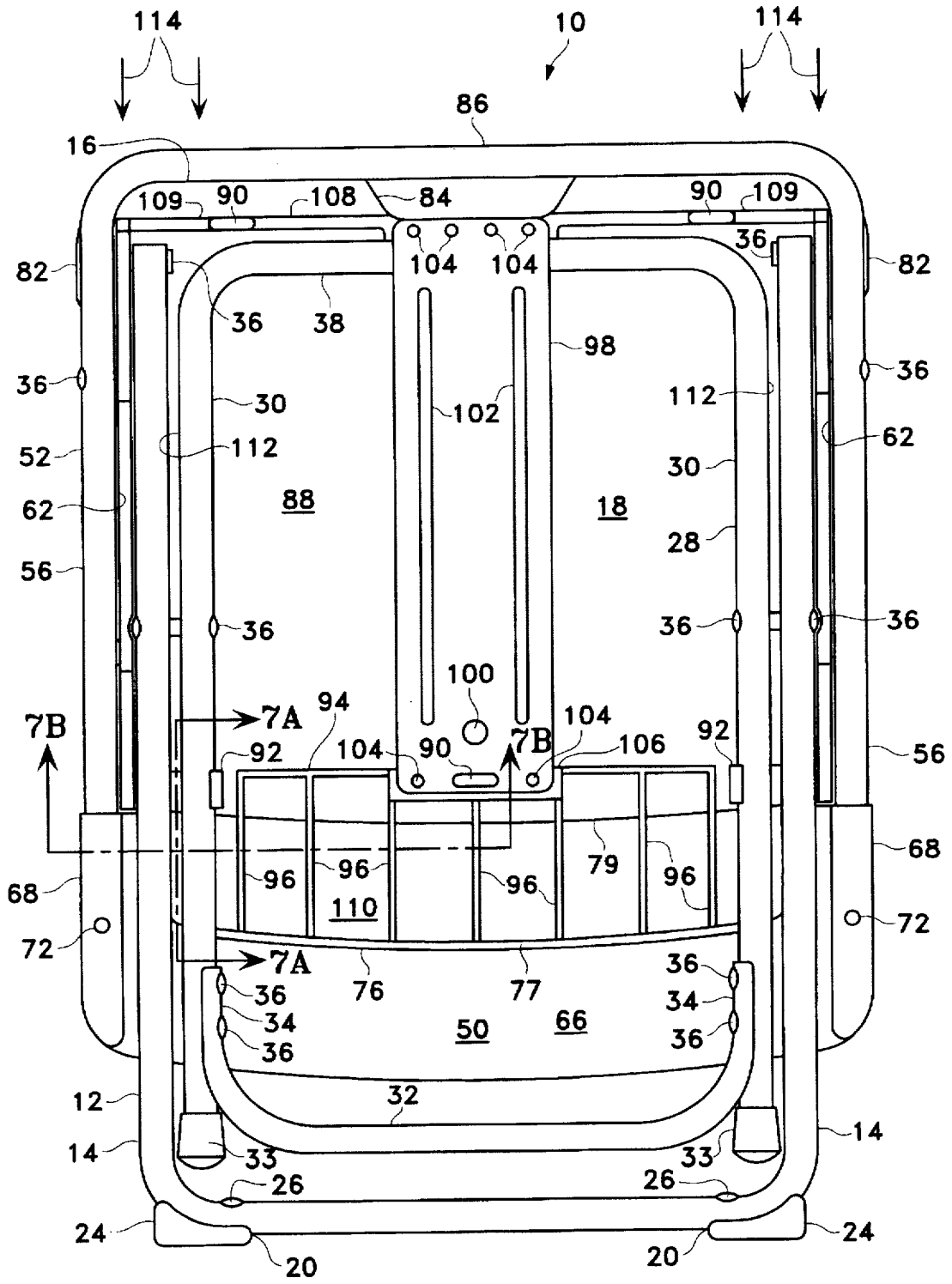
FIG. 7 is a bottom plan view of the chair/table of FIG. 1 shown in the fully folded storage and transport position.
Figure 7A:
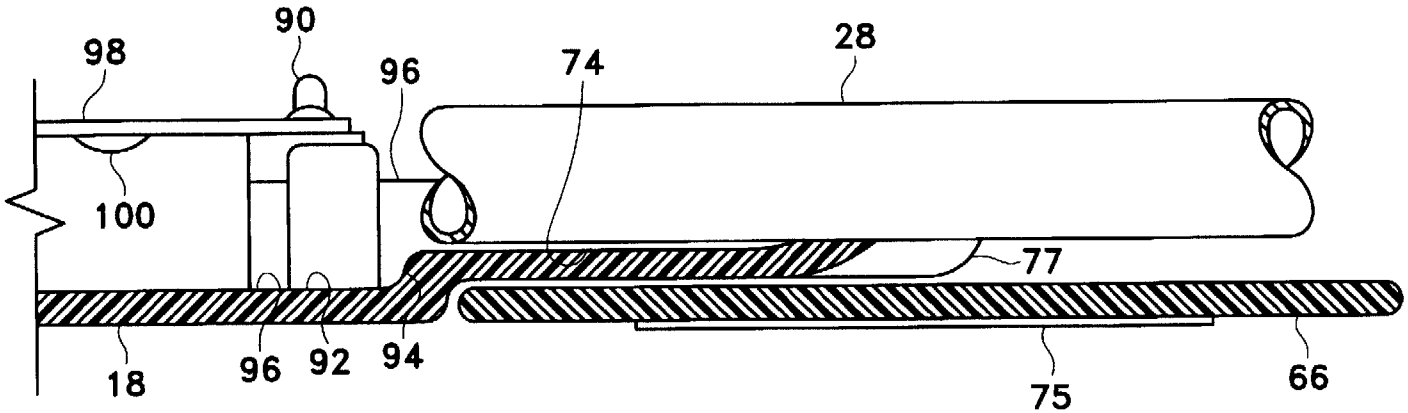
FIG. 7A is a cross section taken along lines 7A—7A of FIG. 7.
Figure 7B:
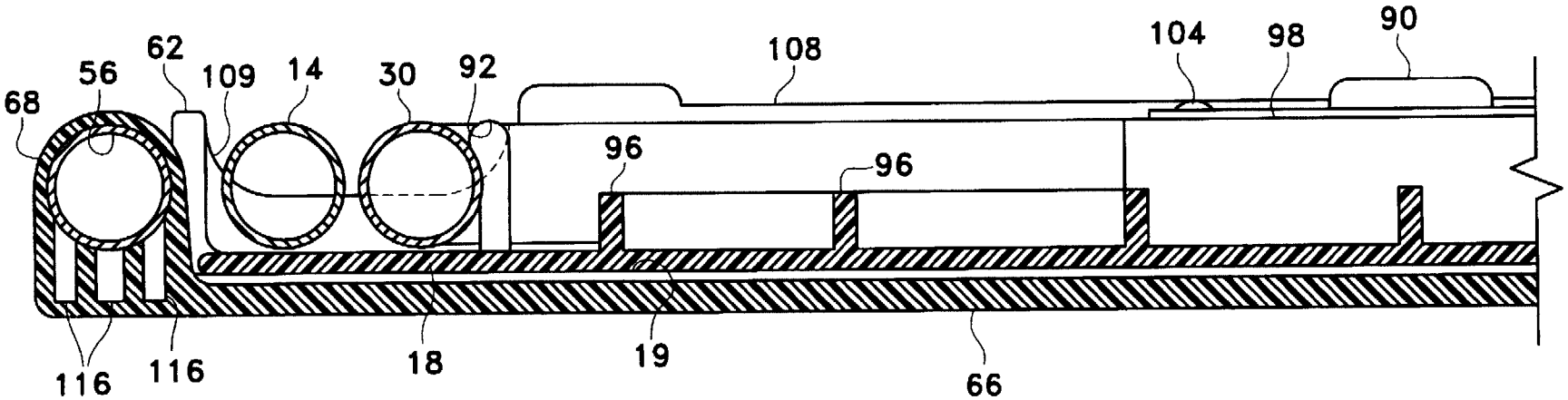
FIG. 7B is a cross section taken along lines 7B—7B of FIG. 7.
Figure 8:
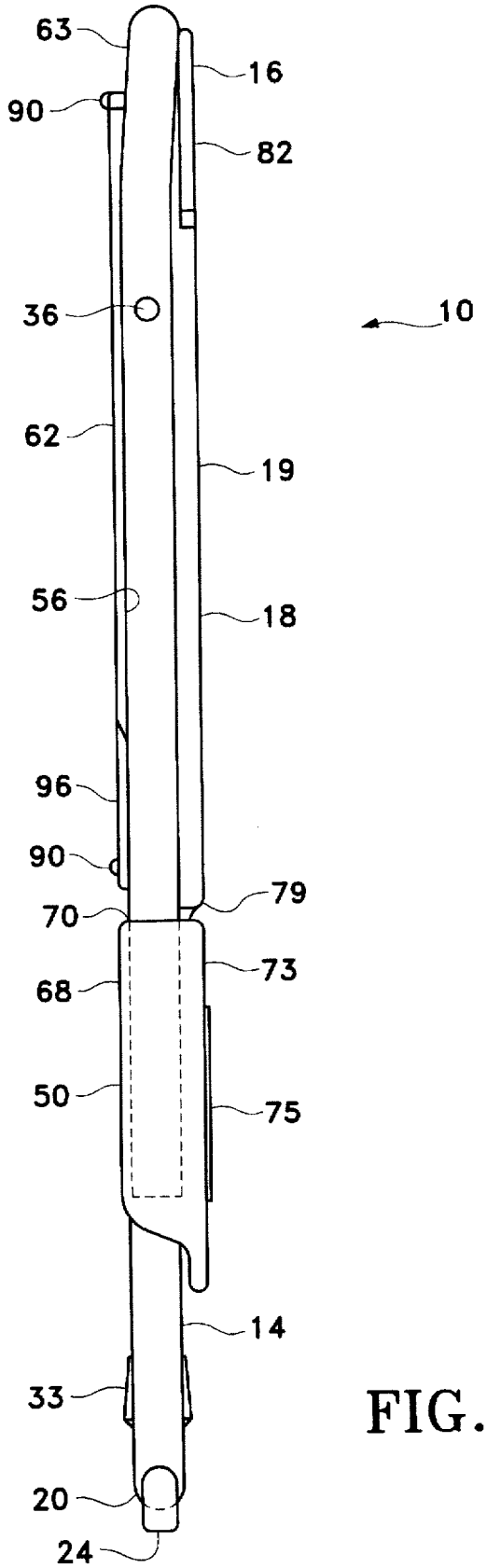
FIG. 8 is a right-hand or left-hand side elevation of the fully folded chair/table of FIG. 1.

Referring to FIGS. 7, 7A, and 7B, the underside surface 88 of the seat 18 includes a depending rear skirt portion 108 (seen in FIGS. 2,5, and 6) for reinforcement, which carries the two rear stacking lugs 90. A third locking lug 90 is located in the approximate center of the forward end of the metal strap slide retainer 98. A forward seat portion 110 includes reenforcing webbing, preferably a series of seven parallel shallow box ribs 96 that run between a step offset ridge 94 and the depending leading edge lip 77, to which they are integrally connected.

A metal strap slide retainer 98 includes a pair of elongated parallel stamped reinforcement ribs 102 and is attached to the depending rear skirt portion 88 by four rivets 104 seated in bosses in the plastic which may include metal inserts, and is similarly attached to an elevated boss area 106 of the step offset ridge 94. A cavity is formed between the underside surface 88 of the seat 18 and the metal strap slide retainer 98, through which the rear leg frame 28, and specifically the horizontal stabilizer member 38, reciprocate when the chair/table 10 is being erected or folded. Because the front leg frame 12 is attached to the rear leg frame 28, both frames are secured in their respective proper positions by the locking dimple 100. In the closed position, a pair of integral upstanding spring catch members 92 secure the rear legs 30 into the folded position.

As seen in FIGS. 7–12, the depending rear skirt portion of the seat 18 includes one reduced height wall section 109 that accommodates the front leg frame 12 and the rear leg frame 28 when these members are in the folded position. In combination with this feature, the back support strip 66 portion of the backrest 50 is tangent to the rear side of the upstanding rearwardly inclined backrest support members 56, to provide a channel 112 along the lines of the arrows 114 of the width indicated by the two pairs of arrows 114 on either side of the chair/table 10 that allows the front leg frame 12 and the rear leg frame 28 to lie closely against the underside surface 88 of the seat 18 when they are in the folded position (See also FIGS. 9–11). These features allow the chair/table 10 to be folded into a very compact form, having a thickness of about 3.8 cm for a full-sized chair. Mold voids 116 are formed in the sleeve 68 portions of the backrest 50 to prevent distortion and shrinkage of the plastic.

Figure 9:
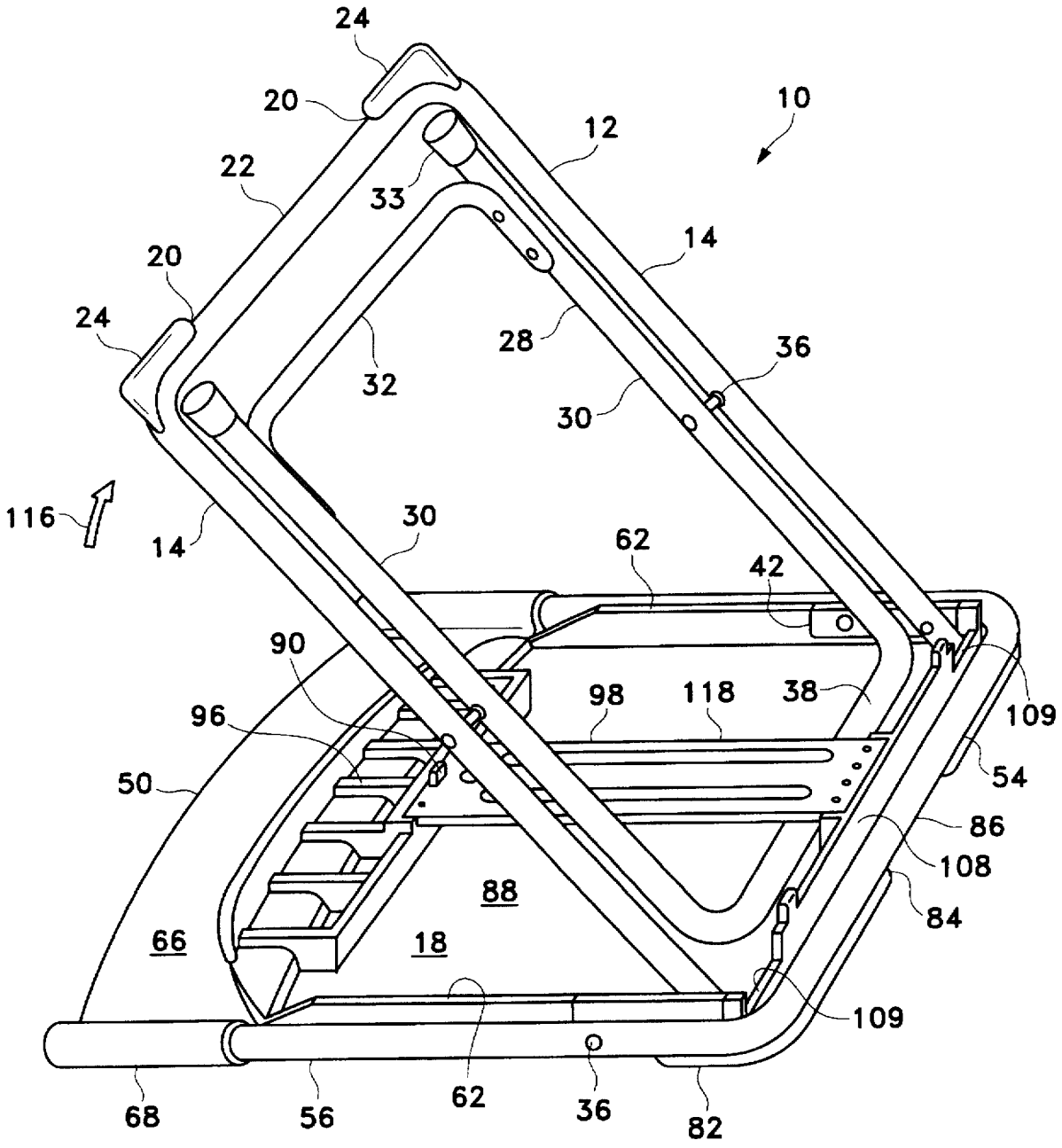
FIG. 9 is a perspective view of the chair/table of FIG. 9 shown with the legs unfolded into an intermediate position.
Figure 10:
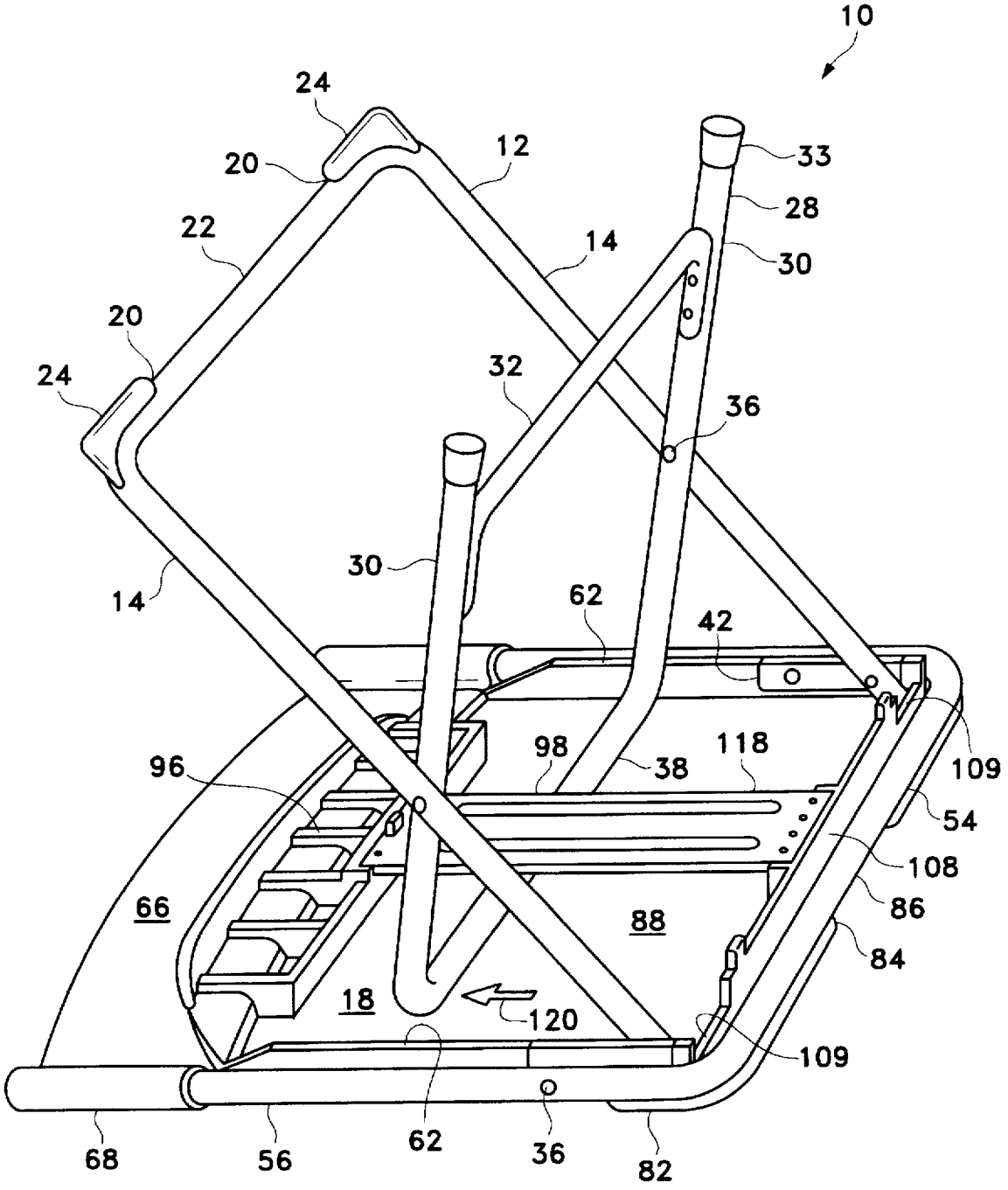
FIG. 10 is a perspective view of the chair/table of FIG. 9 shown with the legs further unfolded into a further intermediate position.
Figure 11:
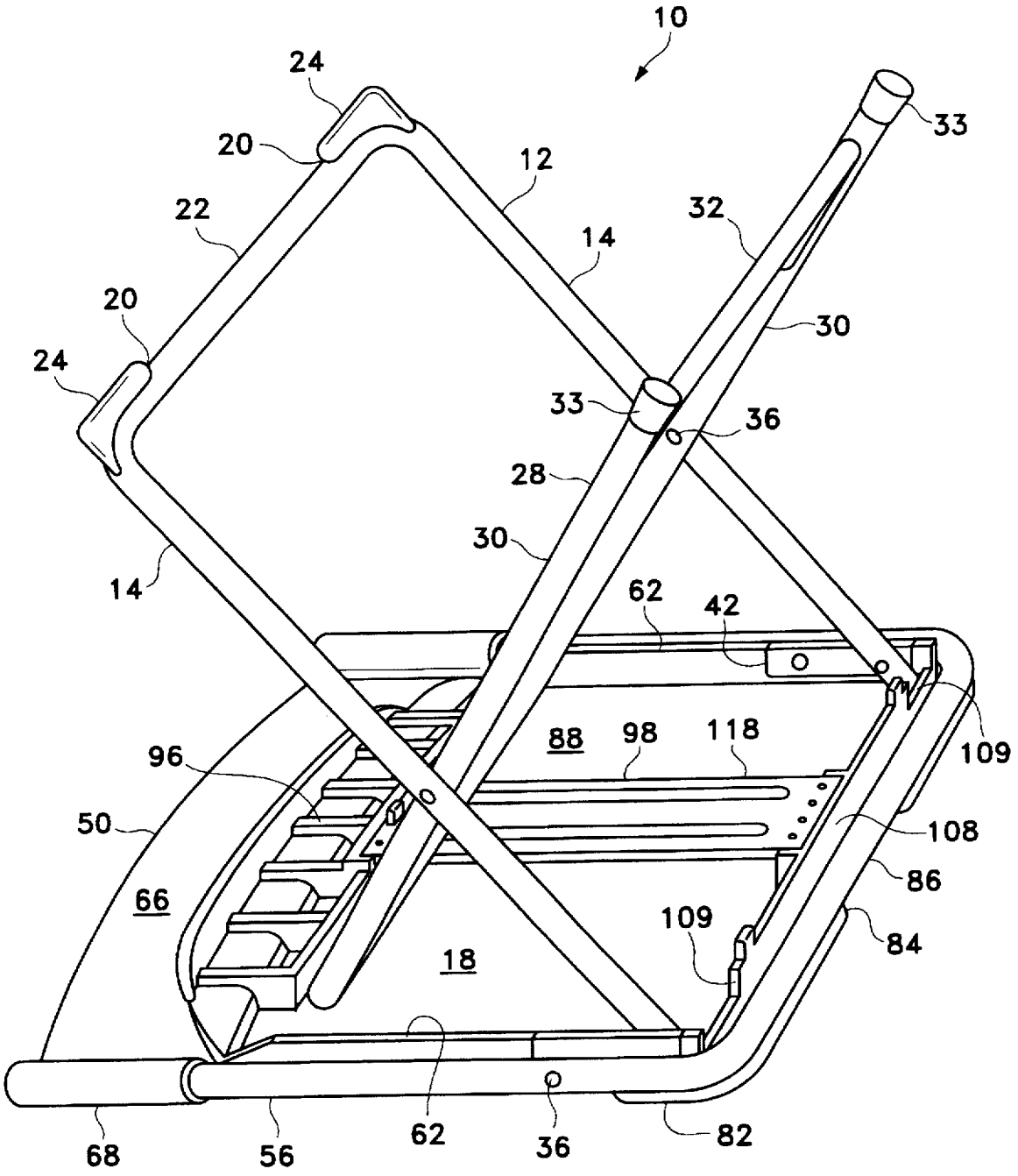
FIG. 11 is a perspective view of the chair/table of FIG. 9 fully unfolded, and ready for use as a table as soon as it is inverted, or for use as a chair when the backrest is erected.

Referring to FIG. 9, both the front and rear leg frames 12, 28 have been released from the molded latching lugs 78 and pivoted counterclockwise in the direction of the arrow 116 with the front leg frame 12 pivoting about the rivets 36 and carrying with it the rear leg frame 28, which pivots in the slide space 118 between the metal strap slide retainer 98 and the underside surface 88 of the seat 18, abutting the depending rear skirt portion 108. The front legs 14 and the rear legs 30 are all substantially parallel during this stage, which is continued until the front leg frame 12 is in its erected position. Next, referring to FIG. 10, the rear leg frame 28 is pivoted in the direction of the arrow about the rivets 36 that fasten it to the front leg frame 12 to form an X-shape and to accomplish this, the horizontal stabilizer member 38 of the rear leg frame 28 slides toward the front edge 76 of the seat 18 within the slide space 118, as indicated by the arrow 120. The movement is continued until the horizontal stabilizer member 38 abuts the step elevated boss area 106 and the congruent step offset ridge 94, when the chair/table 10 is ready for use as a table when it is turned over and set on its legs, as shown in FIG. 11. To use as a chair, the backrest 50 is rotated into the erected position of FIG. 1, for example, as previously discussed. To collapse or fold the chair/table 10 into is storage or transport position, the steps set forth in this paragraph are reversed.

Figure 12:
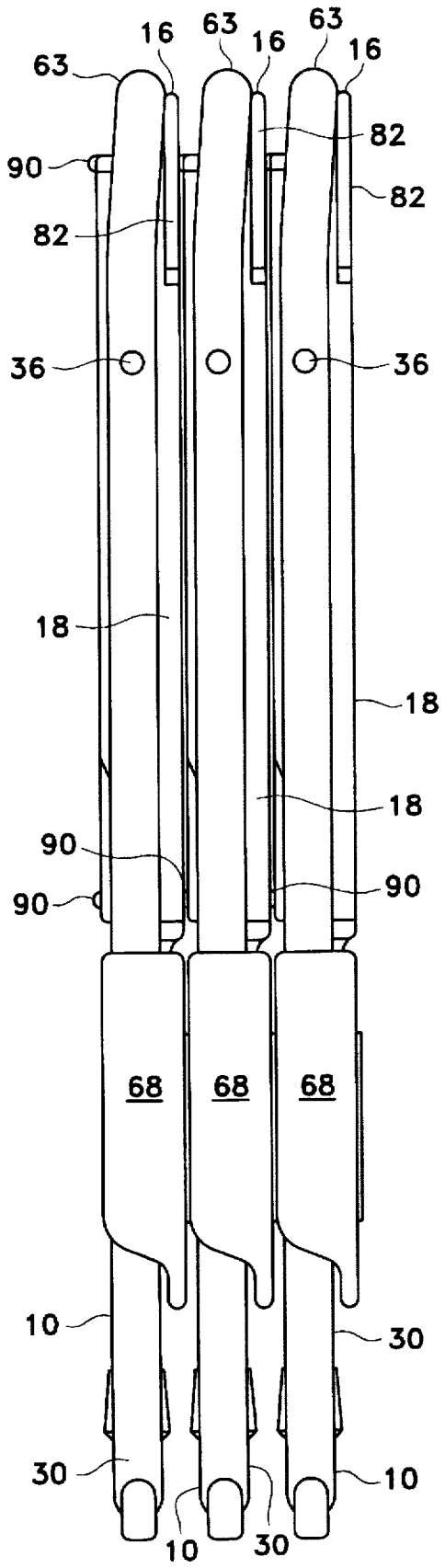
FIG. 12 is a side elevation of three of the chairs/tables of FIG. 1 shown in the their fully folded positions and stacked together.
Figure 13:
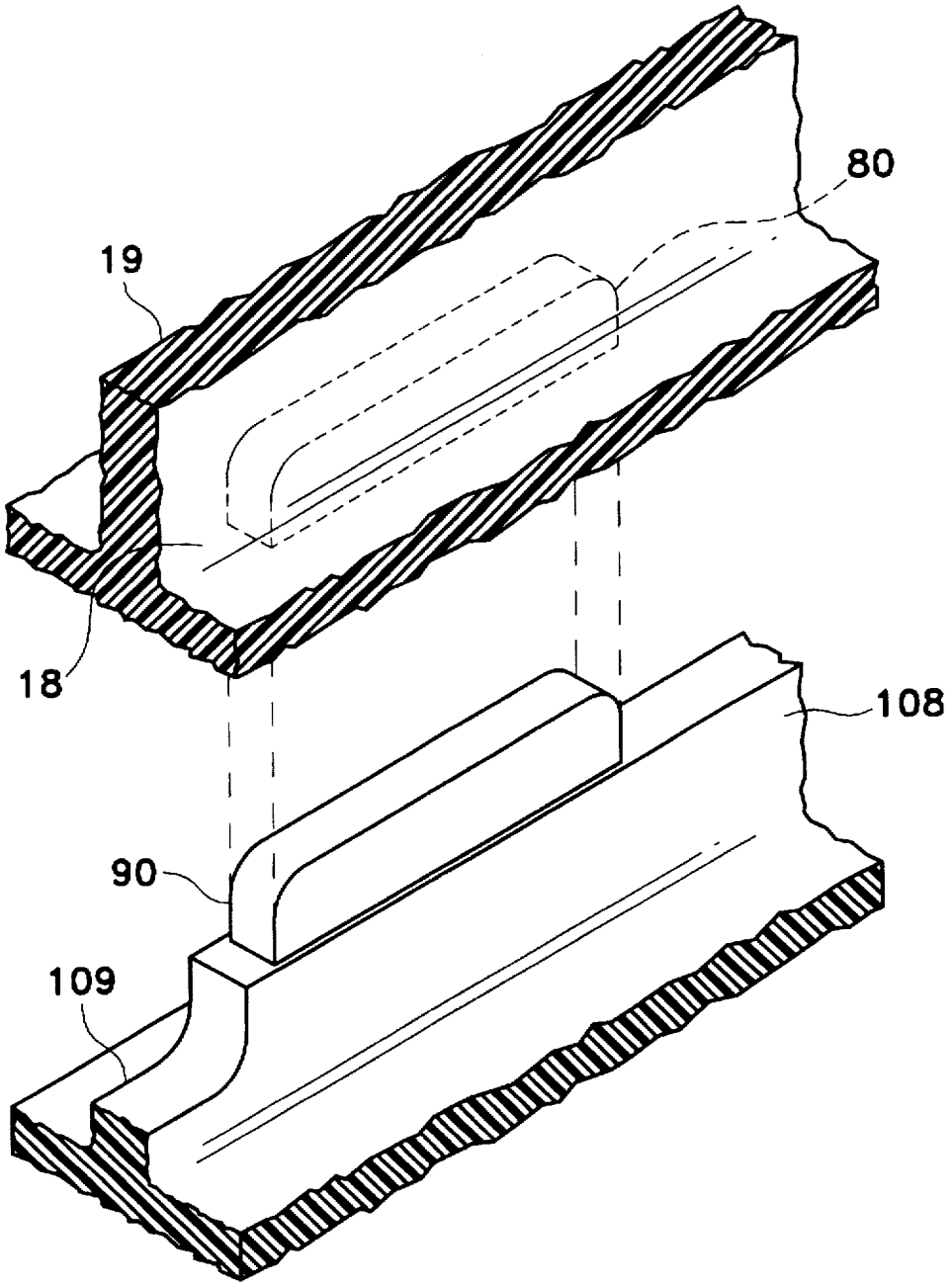
FIG. 13 is an enlarged left-hand front perspective view of a stacking lug and stacking lug receiving slot for fastening a plurality of the chair/tables of FIG. 1 together into a stack.

Referring to FIG. 12, a plurality of the folded chair/tables 10 can be stacked compactly together and held together by mating the stacking lugs 90 into the respective aligned stacking lug receiving slots 80. FIG. 13 illustrates the operation of the stacking lugs 90, which fit into the stacking lug receiving slots 80 for resilient firm mating to firmly fasten adjacent chair/tables 10 together for storage or transportation when they are in the folded position. The fastening effect is readily overcome by a user who is separating the stacked chair/tables 10.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) along a centerline extending from a front edge (76) of said seat (18) to a rear edge (16) of said seat (18) for retaining said horizontal stabilizer member (38) of said rear leg frame (28), means for pivotally attaching an upper end of each said front leg (14) to a rear portion of said seat (18); and d. a backrest (50) comprising a U-shaped backrest frame (52) comprising a pair of spaced parallel backrest support members (56) connected to a backrest brace (54) and a back support strip (66) attached to an upper end of each said spaced parallel backrest support members (56), with said spaced parallel backrest support members (56) being pivotally connected to a depending skirt portion (62) of said seat (18) wherein said backrest brace (54) contacts said front legs (14) when the folding chair is fully erected and wherein said backrest brace (54) pivots downwardly toward a front edge (76) of said seat (18) and a portion of said back support strip (66) seats in a stepped down portion (74) of said seat (18) when said backrest (50) is fully folded down and a rear surface of said backrest strip (66) is level with said upper surface (19) of said seat (18) and said spaced parallel backrest support members (56) and said backrest brace (54) contact a portion of a perimeter of said underside surface (88) of said seat (18), which provide stops for said backrest 50.

2. A folding chair in accordance with claim 1 wherein said rear surface of said backrest strip (66) further comprises at least one cup ring.

3. A folding chair in accordance with claim 1 further comprising a plurality of stacking lug receiving slots formed in said seat (18) and a plurality of stacking lugs formed in said underside surface (88) of said seat (18) whereby a plurality of the folding chairs in a fully folded position can be interlocked to one another.

4. A folding chair in accordance with claim 1 further comprising at least one latching lug formed into a depending skirt portion (62) of said seat (18) whereby said backrest (50) resists upward pivoting when it is in its fully folded position.

5. A folding chair in accordance with claim 1 further comprising a handle access indentation (84) along a rear edge (16) of said seat (16) whereby when the folding chair is in its fully folded position a portion of said horizontal backrest brace (54) comprises a handle for carrying the folding chair.

6. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) along a centerline extending from a front edge (76) of said seat (18) to a rear edge (16) of said seat (18) for retaining said horizontal stabilizer member (38) of said rear leg frame (28) and means for pivotally attaching an upper end of each said front leg (14) to a rear portion of said seat (18) at a point on the underside surface (88) of said seat (18), and a depending skirt portion (62); and d. a U-shaped backrest frame (52) comprising a pair of spaced parallel backrest support members (56) connected to a backrest brace (54) and a back support strip (66) attached to an upper end of each said spaced parallel backrest support members (56), with said spaced parallel backrest support members (56) being pivotally connected to said depending skirt portion (62) of said seat (18), wherein said backrest brace (54) contacts said front legs (14) at a point between said pivotal connection point between said U-shaped front leg frame (12) and said U-shaped rear leg frame (28) and said pivotal attachment between said upper end of each said front leg (14) and said rear portion of said seat (18) when the folding chair is fully erected and said backrest brace (54) pivots downwardly toward a front edge (76) of said seat (18) and a portion of said back support strip (66) seats in a stepped down portion (74)

of said seat (18) when said backrest (50) is fully folded down and a rear surface of said backrest strip (66) is level with said upper surface (19) of said seat (18) and said spaced parallel backrest support members (56) and said backrest brace (54) contact a portion of a perimeter of said underside surface (88) of said seat (18), which provide stops for said backrest 50.

7. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) along a centerline extending from a front edge (76) of said seat (18) to a rear edge (16) of said seat (18) for retaining said horizontal stabilizer member (38) of said rear leg frame (28) and means for pivotally attaching an upper end of each said front leg (14) to a rear portion of said seat (18) at a point on the underside surface (88) of said seat (18), and a stepped down portion (74) adjacent to a front edge (76) of said seat (18), and a depending skirt portion (62) adjacent to two sides of said seat (18) and a rear edge depending skirt portion (108) adjacent to rear edge (16) of said seat (18) and said spaced said parallel backrest support member (56) and said backrest brace (54) contact a portion of a perimeter of said underside surface (88) of said seat (18) which provides stops for said backrest 50; and d. a U-shaped backrest frame (52) comprising a pair of spread parrel backrest support members (56) connected to a central backrest brace (54) and a back support strip (66) attached to an upper end of each said spaced parallel backrest support members (56), with said spaced parallel backrest support members (56) being pivotally connected to said depending skirt portion (62) of said seat (18).

8. A folding chair in accordance with claim 7 wherein said rear edge depending skirt portion (108) further comprises a reduced height wall section (109) at each end of said rear edge depending skirt portion (108).

9. A folding chair in accordance with claim 7 further comprising a plurality of stacking lug receiving slots formed in said seat (18) and a plurality of stacking lugs formed in said underside surface (88) of said seat (18) whereby a plurality of the folding chairs in a fully folded position can be attached to one another.

10. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) for retaining a horizontal stabilizer member (38) said rear leg frame (28) and means for pivotally attaching an upper end of each said front leg (14) to a rear portion of said seat (18); and d. a backrest (50) comprising a U-shaped backrest frame (52) comprising a pair of spaced parallel backrest support members (56) connected to a backrest brace (54) and a back support strip (66) attached to an upper end of each said spaced parallel backrest support members (56), wherein said backrest brace (54) contacts said front legs (14) when the folding chair is fully erected said horizontal backrest brace (54) pivots downwardly toward a front edge (76) of said seat (18) and a portion of said back support strip (66) seats in a stepped down portion (74) of said seat (18) when said backrest (50) is fully folded down and a rear surface of said backrest strip (66) is level with said upper surface (19) of said seat (18) and said rear surface of said backrest strip (66) further comprises at least one cup ring.

11. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18)for retaining said horizontal stabilizer member (38) said rear leg frame (28) and means for pivotally attaching an upper end of each said front leg (14) to a rear portion of said seat (18); and d. a plurality of stacking lug receiving slots formed in said seat (18) and a plurality of stacking lugs formed in said underside surface (88) of said seat (18) whereby a plurality of the folding chairs in a fully folded position can be interlocked to one another.

12. A folding chair in accordance with claim 11 further comprising at least one latching lug formed into a depending skirt portion (62) of said seat (18) whereby said backrest (50) resists upward pivoting when it is in its fully folded position.

13. A folding chair in accordance with claim 11 further comprising a handle access indentation (84) along a rear edge (16) of said seat (16) whereby when the folding chair is in its fully folded position a portion of said horizontal backrest brace (54) comprises a handle for carrying the folding chair.

14. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) for retaining said horizontal stabilizer member (38) of said rear leg frame (28) and means for pivotally attaching an upper end of each said front leg (14) to a rear portion of said seat (18) at a point on the underside surface (88) of said seat (18), and a stepped down portion (74) adjacent to a front edge (76) of said seat (18) and said seat (18) further comprising a depending skirt portion (62) adjacent to two sides of said seat (18) and a rear edge depending skirt portion (108) adjacent to a rear edge (16) of said seat (18), said read edge depending skirt portion (108) further comprising a reduced height wall section (109) at each end of said rear edge depending skirt portion (108); and d. a U-shaped backrest frame (52) comprising a pair of spaced parallel backrest support members (56) connected to a central backrest brace (54) and a back support strip (66) attached to an upper end of each said spaced parallel backrest support members (56), with said spaced parallel backrest support members (56) being pivotally connected to said depending skirt portion (62) of said seat (18).

15. A folding chair comprising:

a. a U-shaped front leg frame (12) comprising a pair of front legs (14);

b. a U-shaped rear leg frame (28) having a width narrower than a width of said front leg frame (12), with said U-shaped front leg frame (12) and said U-shaped rear leg frame (28) being pivotally connected to one another and said rear leg frame (28) comprising a pair of rear legs (30) interconnected at their upper ends by a horizontal stabilizer member;

c. a seat (18) having an upper surface (19) and an underside surface (88) and a slide retainer (98) fastened to said underside surface of said seat (18) for retaining said horizontal stabilizer member (38) of said rear leg frame (28) and means for pivotally attaching an upper end of each said from leg (14) to a rear portion of said seat (18) at a point on the underside surface (88) of said seat (18), and a stepped down portion (74) adjacent to a front edge (76) of said seat (18);

d. a U-shaped backrest frame (52) comprising a pair of spaced parallel backrest support members (56) connected to a central backrest brace (54) and a back support strip (66) attached to an upper end of each said spaced parallel backrest support members (56), with said spaced parallel backrest support members (56) being pivotally connected to said depending skirt portion (62) of said seat (18); and e. a plurality of stacking lug receiving slots formed in said seat (18) and a plurality of stacking lugs formed in said underside surface (88) of said seat (18) whereby a plurality of the folding chairs in a fully folded position can be attached to one another.

* * * * *